US010839994B2

(12) United States Patent
Kim et al.

(10) Patent No.: US 10,839,994 B2
(45) Date of Patent: Nov. 17, 2020

(54) VARISTOR AND METHOD OF MANUFACTURING THE SAME

(71) Applicant: SAMSUNG ELECTRO-MECHANICS CO., LTD., Suwon-si, Gyeonggi-do (KR)

(72) Inventors: Ic Seob Kim, Suwon-si (KR); Jung Il Kim, Suwon-si (KR); Yong Sung Kim, Suwon-si (KR); Hae In Kim, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 16/570,047

(22) Filed: Sep. 13, 2019

(65) Prior Publication Data

US 2020/0168372 A1 May 28, 2020

(30) Foreign Application Priority Data

Nov. 27, 2018 (KR) ..... 10-2018-0148323

(51) Int. Cl.
*H01C 7/12* (2006.01)
*H01C 1/14* (2006.01)
(Continued)

(52) U.S. Cl.
CPC ..... *H01C 7/12* (2013.01); *H01C 1/02* (2013.01); *H01C 1/14* (2013.01); *H01C 13/02* (2013.01); *H01C 17/065* (2013.01)

(58) Field of Classification Search
CPC ... H01C 7/12; H01C 1/02; H01C 1/14; H01C 13/02; H01C 17/065
See application file for complete search history.

(56) References Cited

U.S. PATENT DOCUMENTS 5,262,754 A * 11/1993 Collins ..... H01C 7/105 338/20
8,896,409 B2 * 11/2014 Okinaka ..... H01C 7/10 338/21
(Continued)

FOREIGN PATENT DOCUMENTS

JP 2000-133409 A 5/2000
JP 2003-297524 A 10/2003
(Continued)

OTHER PUBLICATIONS

Korean Office Action dated Oct. 23, 2019 issued in Korean Patent Application No. 10-2018-0148323 (with English translation).

*Primary Examiner* — Kyung S Lee
(74) *Attorney, Agent, or Firm* — Morgan, Lewis & Bockius LLP

(57) ABSTRACT

A varistor includes a substrate; first and second electrodes disposed on an upper side and a lower side of the substrate, respectively; a core varistor body surrounded by the substrate and disposed between the first and second electrodes; first and second terminals having at least portions disposed on one side and the other side of the substrate, respectively, and electrically connected to the first and second electrodes, respectively; and a cover varistor body covering the core varistor body and disposed in a level higher than an upper surface of the substrate or disposed in a level lower than a lower surface of the substrate.

13 Claims, 10 Drawing Sheets

(51) Int. Cl.

| | |
|---|---|
| ***H01C 17/065*** | (2006.01) |
| ***H01C 13/02*** | (2006.01) |
| ***H01C 1/02*** | (2006.01) |

(56) References Cited

U.S. PATENT DOCUMENTS

| | | | | |
|---|---|---|---|---|
| 9,224,728 | B2 * | 12/2015 | Kosowsky | H01L 27/0288 |
| 10,262,778 | B2 * | 4/2019 | Wozniak | B32B 18/00 |
| 2007/0132540 | A1 * | 6/2007 | Matsuoka | H01C 17/30 338/21 |
| 2009/0116168 | A1 * | 5/2009 | Block | H01C 7/18 361/306.3 |
| 2013/0162388 | A1 * | 6/2013 | Gomi | H01C 7/102 338/21 |
| 2014/0085043 | A1 * | 3/2014 | Suzuki | H01C 7/1006 338/21 |
| 2015/0223369 | A1 * | 8/2015 | Otsubo | H01T 2/02 361/111 |

FOREIGN PATENT DOCUMENTS

| | | | |
|---|---|---|---|
| KR | 20-0408406 | Y1 | 2/2006 |
| KR | 10-2009-0030140 | A | 3/2009 |
| KR | 10-1813612 | B1 | 1/2018 |

* cited by examiner

VARISTOR AND METHOD OF MANUFACTURING THE SAME

CROSS-REFERENCE TO RELATED APPLICATION(S)

This application claims benefit of priority to Korean Patent Application No. 10-2018-0148323 filed on Nov. 27, 2018 in the Korean Intellectual Property Office, the disclosure of which is incorporated herein by reference in its entirety.

TECHNICAL FIELD

The present disclosure relates to a varistor and a method of manufacturing the same.

BACKGROUND

Generally, information communication devices such as advanced IT terminals, and the like, have been designed to include a semiconductor device/chip/module with increased integration density to which a fine line width technology is applied and to use a high efficiency passive device such as a multilayer ceramic capacitor (MLCC) so as to reduce a size and to use low power.

However, such a semiconductor device/chip/module may be vulnerable to withstand voltage, and the like, such that a semiconductor device/chip/module may be broken or may malfunction due to a surge or electrostatic discharge (ESD) caused in various routes.

A varistor may be used to absorb a surge or to filter electrostatic discharge.

Also, recently, automobiles have been developed as highly advanced electronic products based on ICT convergence, rather than being developed as mechanical products.

A semiconductor device/chip/module and a passive device included in an automobile may also be broken or malfunction due to a surge or electrostatic discharge.

For example, if an automotive smart car malfunctions for any such reason, safety of a driver and pedestrians may be compromised. Accordingly, it may be important to prevent a surge from flowing into a circuit and to control a surge.

Thus, an automobile may use a varistor for protecting a semiconductor device/chip/module.

As mentioned above, a varistor has been increasingly used in various fields, and a varistor may thus be required to have a variety of properties to be used in various fields.

For example, a varistor used in a relatively adverse environment such as being used as a component for vehicles may be required to have increased strength, and a varistor used in IT terminals may be required to have improved strength in an assigned unit size such that a varistor may have a structure to be easily miniaturized.

One of factors determining strength of a varistor may be a grain boundary. However, it may be difficult to secure advanced strength only based on a grain boundary.

SUMMARY

An aspect of the present disclosure is to provide a varistor having improved strength and/or having a structure facilitating miniaturization, and a method of manufacturing the same.

According to an aspect of the present disclosure, a varistor is provided, the varistor including a substrate; first and second electrodes disposed on an upper side and a lower side of the substrate, respectively; a core varistor body surrounded by the substrate and disposed between the first and second electrodes; first and second terminals having at least portions disposed on one side and the other side of the substrate, respectively, and electrically connected to the first and second electrodes, respectively; and a cover varistor body covering the core varistor body and disposed in a level higher than an upper surface of the substrate or disposed in a level lower than a lower surface of the substrate.

According to an aspect of the present disclosure, a method of manufacturing a varistor is provided, the method including forming a through-hole in a substrate; printing a first varistor paste on the through-hole; drying the substrate in which at least a portion of the through-hole is filled with the first varistor paste; printing a second varistor paste on an upper side or a lower side of the through-hole of the dried substrate; sintering the substrate on which the second varistor paste is printed; forming first and second electrodes on an upper side and a lower side of the sintered substrate, respectively; and forming first and second terminals on one side and the other side of the sintered substrate, respectively.

According to an aspect of the present disclosure, a varistor is provided, the varistor including a substrate; a first core varistor body penetrating through the substrate and exposed from upper and lower surfaces of the substrate; first and second terminals disposed on opposing sides of the substrate, respectively, and extending onto the upper and lower surfaces of the substrate; a first electrode extending from an extending portion of the first terminal on the upper surface and covering a first end of the first core varistor exposed from the upper surface; and a second electrode extending from an extending portion of the second terminal on the lower surface and covering a second end of the first core varistor exposed from the lower surface.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1A:
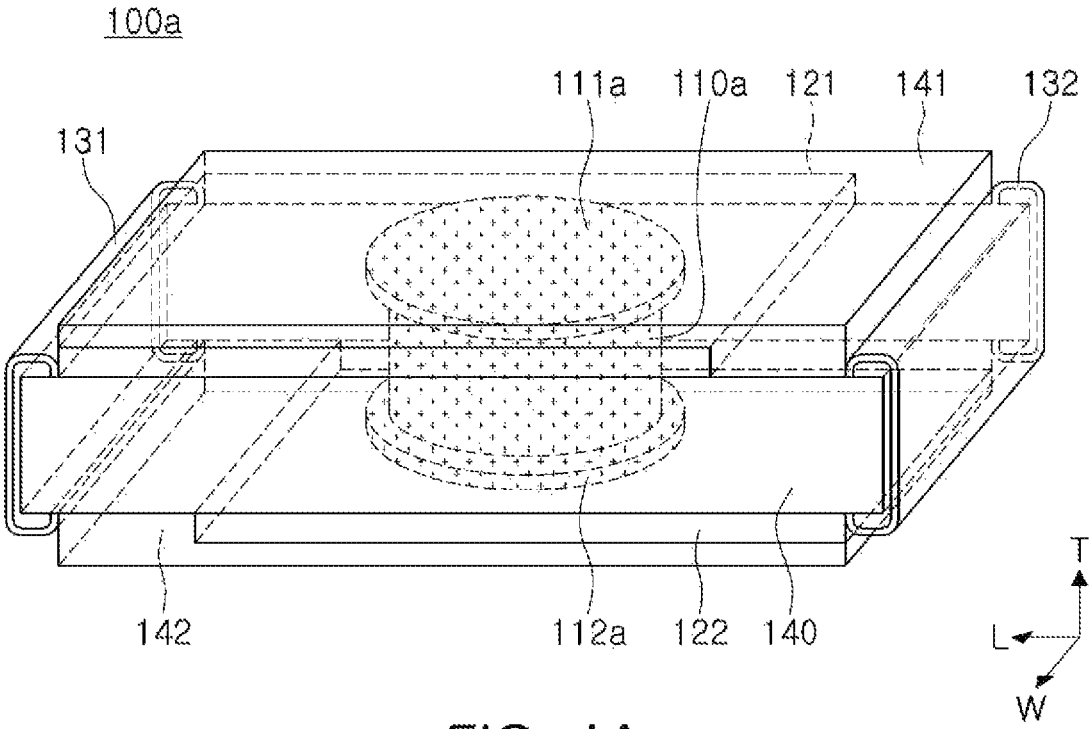
FIG. 1A is a perspective view illustrating a single core structure of a varistor according to an example embodiment of the present disclosure.

Hereinafter, embodiments of the present disclosure will be described as follows with reference to the attached drawings.

These embodiments are described in sufficient detail to enable those skilled in the art to practice the invention. It is to be understood that the various embodiments of the invention, although different, are not necessarily mutually exclusive. For example, structures, shapes, and sizes described as examples in embodiments in the present disclosure may be implemented in another example embodiment without departing from the spirit and scope of the present disclosure. Shapes and sizes of elements in the drawings may be exaggerated for clarity of description, and the same elements will be indicated by the same reference numerals.

For clarity of description, some elements may be omitted or briefly illustrated, and thicknesses of elements may be magnified to clearly represent layers and regions.

It will be understood that when a portion "includes" an element, it can further include another element, not excluding another element, unless otherwise indicated.

With respect to directions of a hexahedron, L, W, and T indicated in the drawings are defined as a length direction, a width direction, and a thickness direction, respectively.

Figure 2A:
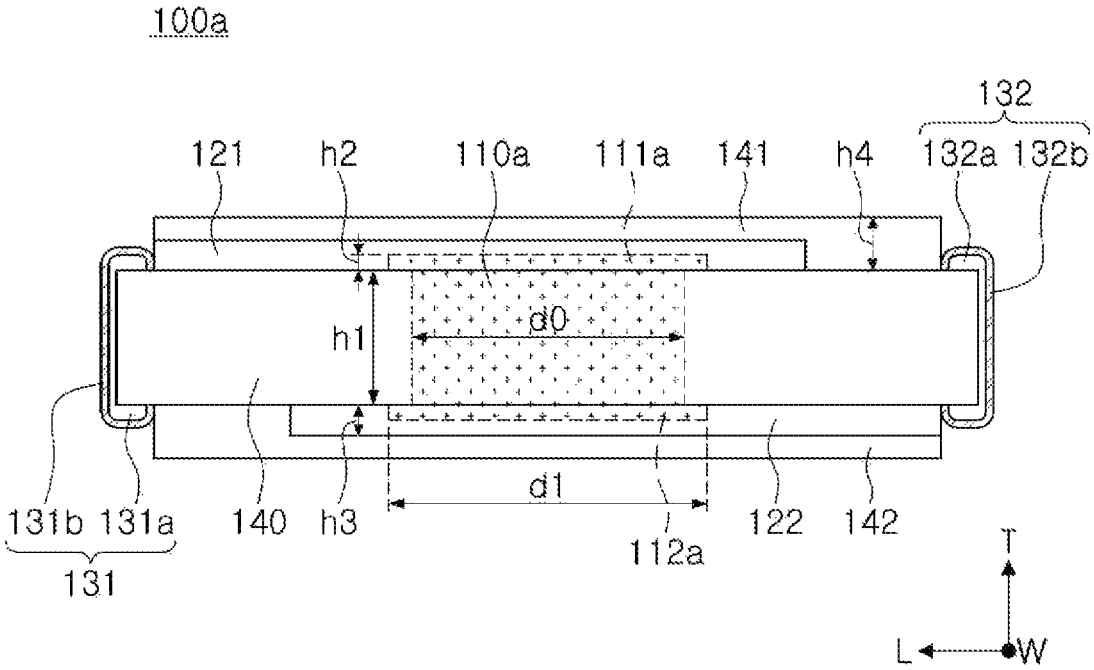
FIG. 2A is a side view illustrating a single core structure of a varistor according to an example embodiment of the present disclosure.

FIG. 1A is a perspective view illustrating a single core structure of a varistor according to an example embodiment. FIG. 2A is a side view illustrating a single core structure of a varistor according to an example embodiment.

Referring to FIGS. 1A and 2A, a varistor 100*a* in the example embodiment may include a core varistor body 110*a*, cover varistor bodies 111*a* and 112*a*, a first electrode 121, a second electrode 122, a first terminal 131, a second terminal 132, and a substrate 140.

A resistance value of the core varistor body 110*a* and the cover varistor bodies 111*a* and 112*a* may change. In other words, the core varistor body 110*a* and the cover varistor bodies 111*a* and 112*a* may have non-linear I-V (current-voltage) properties. For example, the core varistor body 110*a* and the cover varistor bodies 111*a* and 112*a* may include ZnO and may be implemented by a ZnO—$Bi_2O_3$ based material and a ZnO—$Pr_6O_{11}$ based material, and may also include additives such as Zn, Bi, Sb, Co, Mn, Si, Ni, Zr, and the like. The additives may be related to formation of a secondary crystalline phase and formation of liquid of the core varistor body 110*a* and the cover varistor bodies 111*a* and 112*a*. In one example, the core varistor body 110*a* and the cover varistor bodies 111*a* and 112*a* may made of the same material, although the prevent disclosure is not limited thereto.

The first and second electrodes 121 and 122 may be disposed on an upper side and a lower side of the substrate 140. When a voltage applied between the first electrode 121 and the second electrode 122 is relatively low, the core varistor body 110*a* and the cover varistor bodies 111*a* and 112*a* may have a relatively high resistance value and may insulate the first electrode 121 and the second electrode 122 from each other.

The higher the voltage applied between the first electrode 121 and the second electrode 122, the lower the resistance value of the core varistor body 110*a* and the cover varistor bodies 111*a* and 112*a*, and the resistance value may rapidly decrease when the voltage is higher than a breakdown voltage of the varistor 100*a*.

Thus, the voltage applied between the first and second electrodes 121 and 122 may form an electrical field at a shortest route between the first and second electrodes 121 and 122 in the varistor 100*a*. The electrical field may accumulate electrons on one end of the first electrode 121 and one end of the second electrode 122, and may build up the electrons along the shortest route. The greater the size of the electrical field, the higher the height of the built-up electrons.

When the electrical field is greater than a magnitude of a breakdown voltage, the electrons on one end of the first electrode 121 and the electrons on one end of the second electrode 122 may work as electrical paths.

The longer the shortest distance between the first electrode 121 and the second electrode 122, the higher the breakdown voltage of the varistor 100*a*.

The first and second terminals 131 and 132 may be electrically connected to the first and second electrodes 121 and 122, respectively, may be spaced apart from each other, and may be disposed on one side (e.g., a left side surface) and the other side (e.g., a right side surface) of the substrate 140, respectively.

For example, the first and second terminals 131 and 132 may include base terminals 131*a* and 132*a* and plating layers 131*b* and 132*b*. The base terminals 131*a* and 132*a* may include Ag or AgPd similarly to the first and second electrodes 121 and 122, but an example embodiment thereof is not limited thereto. The plating layers 131*b* and 132*b* may include an Ni-plated layer and an Sn-plated layer, but an example embodiment thereof is not limited thereto.

The substrate 140 may surround the core varistor body 110*a*. Accordingly, the substrate 140 may protect the core varistor body 110*a* from external impacts, thereby improving overall strength of the varistor 100*a* of the example embodiment.

The substrate 140 may have a thickness h1 the same as, or substantially the same as, the core varistor body 110*a*, and may have enhanced strength as compared to the core varistor body 110*a*, thereby improving overall strength of the varistor 100*a* having a reduced size. Accordingly, in the example embodiment, the varistor 100*a* may secure reliability and may have a reduced size and thickness.

For example, the substrate 140 may be configured as an alumina substrate to have improved strength in a reduced thickness as compared to the core varistor body 110*a*. An alumina substrate may have great strength, and may effectively emit heat produced from the core varistor body 110*a*.

When a surrounding temperature increases (e.g., during a sintering process), an amount of change in volume of the substrate 140 may be different from an amount of change in volume of the core varistor body 110*a* due to a difference in contraction rate between the substrate 140 and the core varistor body 110*a*.

Accordingly, a gap may be formed between the substrate 140 and the core varistor body 110*a*. The gap may degrade reliability of I-V properties or reliability of capacitance properties of the core varistor body 110*a*, and may work as a path of sparks between the first and second electrodes 121 and 122 while a relatively high surge voltage, and the like, is applied. The gap may also decrease strength of the varistor 100*a* having a reduced size.

The cover varistor bodies 111*a* and 112*a* may be connected to the core varistor body 110*a*, and may be disposed in a level higher than an upper surface of the substrate 140 or may be disposed in a level lower than a lower surface of the substrate 140.

Accordingly, at least a portion of the gap between the substrate 140 and the core varistor body 110*a* may be filled with a varistor body by including the cover varistor bodies 111*a* and 112*a*.

Accordingly, in the example embodiment, the varistor 100*a* may improve reliability of I-V properties or reliability of capacitance properties of the core varistor body 110*a*, may prevent a path of sparks between the first and second electrodes 121 and 122, and may have improved strength in a reduced thickness.

For example, the cover varistor bodies 111*a* and 112*a* may have an upper surface or a lower surface greater than an upper surface and a lower surface of the core varistor body 110*a*. Accordingly, a width d1 of each of the cover varistor bodies 111*a* and 112*a* may be greater than a width d0 of the core varistor body 110*a*. Thus, the gap between the substrate 140 and the core varistor body 110*a* may be effectively filled with a varistor body.

For example, the cover varistor bodies 111*a* and 112*a* may be disposed on an upper side and a lower side of the core varistor body 110*a* to form an I-shaped form with the core varistor body 110*a*. Accordingly, the gap between the substrate 140 and the core varistor body 110*a* may be effectively filled with a varistor body.

The varistor 100*a* in the example embodiment may further include a first insulating layer 141 disposed on an upper side of the first electrode 121, and a second insulating layer 142 disposed on a lower side of the second electrode 122. Accordingly, sparks flowing on a side surface of the substrate 140 between the first electrode 121 and the second electrode 122 may be prevented.

For example, the first and second insulating layers 141 and 142 may be implemented by an insulating material such as glass, epoxy, $SiO_2$, $Al_2O_3$, an organic material, and the like, and may include two types of insulating materials disposed in an upper portion and a lower portion.

A width of each of the first and second electrodes 121 and 122 may be greater than a width of each of the cover varistor bodies 111*a* and 112*a*, and may be less than a width of the substrate 140. The first and second insulating layers 141 and 142 may cover portions of an upper surface and a lower surface of the substrate 140 in which the first and second electrodes 121 and 122 are not disposed, and may thus effectively insulate the first and second electrodes 121 and 122.

A thickness h4 of each of the first and second insulating layers 141 and 142 may be greater than a thickness h3 of each of the first and second electrodes 121 and 122, and may be greater than a thickness h2 of each of the cover varistor bodies 111*a* and 112*a*. However, an example embodiment thereof is not limited thereto.

Figure 1B:
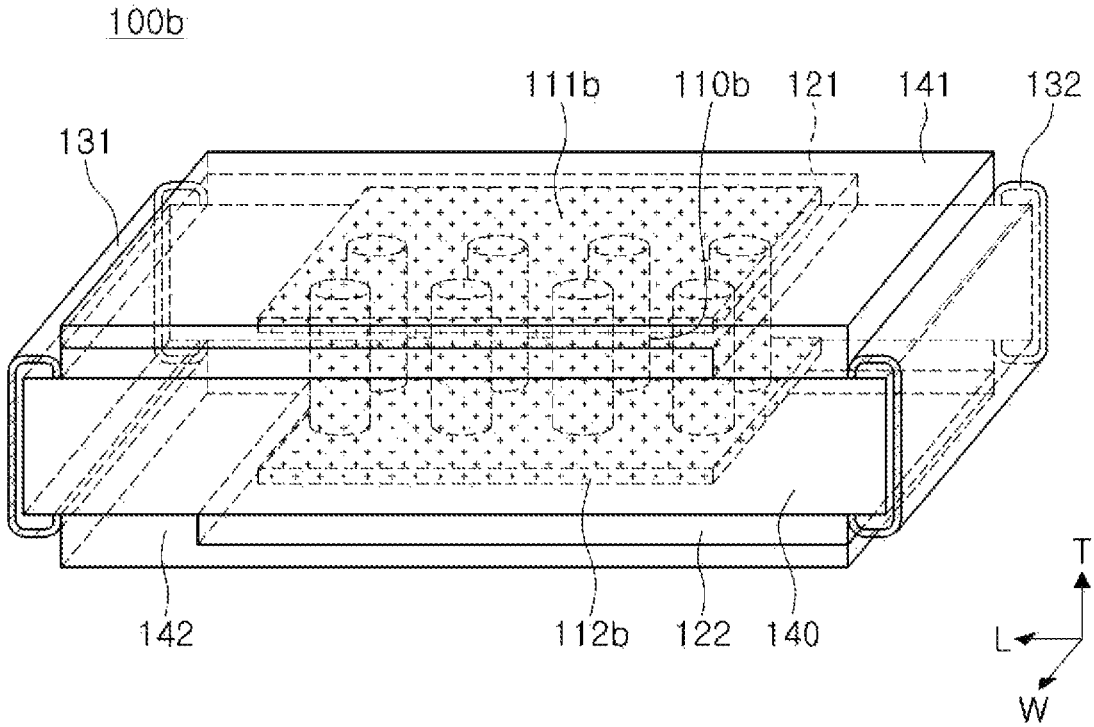
FIG. 1B is a perspective view illustrating a multiple core structure of a varistor according to an example embodiment of the present disclosure.
Figure 2B:
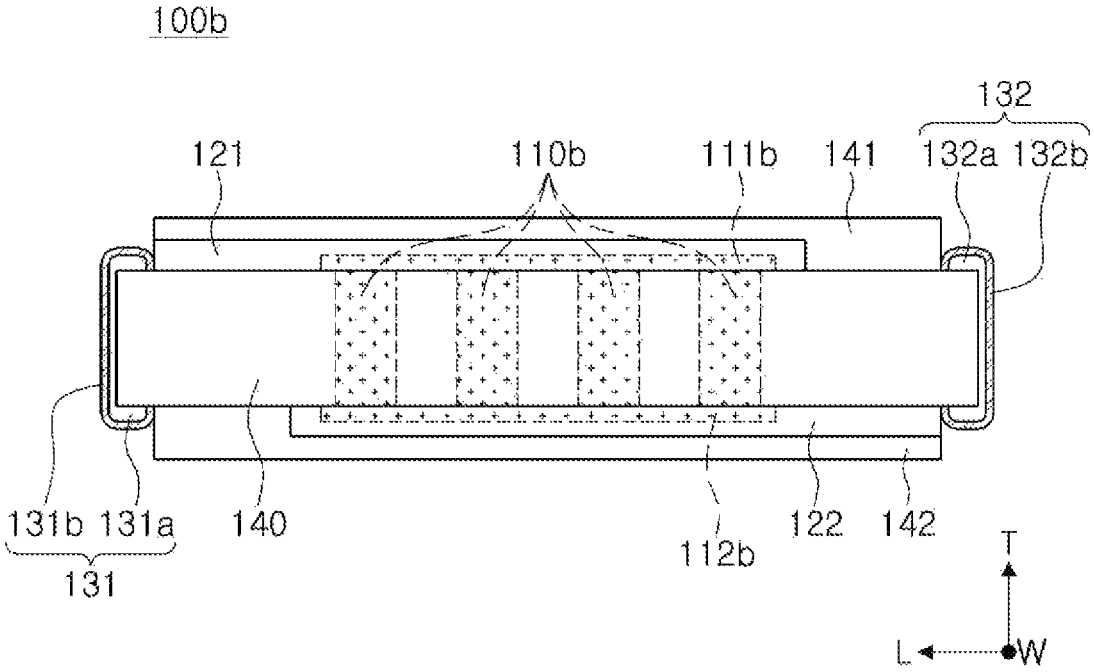
FIGS. 2B and 2C are side views illustrating a multiple core structure of a varistor according to an example embodiment of the present disclosure.

FIG. 1B is a perspective view illustrating a multiple core structure of a varistor according to an example embodiment. FIG. 2B is a side view illustrating a multiple core structure of a varistor according to an example embodiment.

Referring to FIGS. 1B and 2B, a varistor 100*b* in the example embodiment may include a plurality of core varistor bodies 110*b*, cover varistor bodies 111*b* and 112*b*, a first electrode 121, a second electrode 122, a first terminal 131, a second terminal 132, and a substrate 140.

The plurality of core varistor bodies 110*b* may include first and second core varistor bodies, and may have a form similar to a form of the core varistor body 110*a* illustrated in FIGS. 1A and 2A.

I-V properties of the varistor 100*b* in the example embodiment may be dependent on a sum of areas in a length-width cross-section of the plurality of core varistor bodies 110*b*. That is because a sum of areas in a length-width cross-section of the plurality of core varistor bodies 110*b* may correspond to an area of a resistance model.

For example, the plurality of core varistor bodies 110*b*, as a whole, may have an overall area and/or a volume similar to an area and/or a volume of the core varistor body 110*a* illustrated in FIGS. 1A and 2A to have I-V properties similar to the I-V properties of the core varistor body 110*a* illustrated in FIGS. 1A and 2A.

As the varistor 100*b* in the example embodiment has a multiple core structure, even when a defect occurs in some of the plurality of core varistor bodies 110*b*, a basic function of the varistor 100*b* may be maintained.

In the varistor 100*b* in the example embodiment, heat may be effectively emitted from the substrate 140 as the plurality of core varistor bodies 110*b* are distributed.

The cover varistor bodies 111*b* and 112*b* may cover the plurality of core varistor bodies 110*b* together.

Accordingly, the varistor 100*b* in the example embodiment may stably maintain reliability of I-V properties or reliability of capacitance properties even when a defect occurs in some of the plurality of core varistor bodies 110*b*, and a plurality of gaps between the plurality of core varistor bodies 110*b* and the substrate 140 may be effectively filled.

The first and second electrodes 121 and 122 may be configured to cover the plurality of core varistor bodies 110*b* together.

Figure 2C:
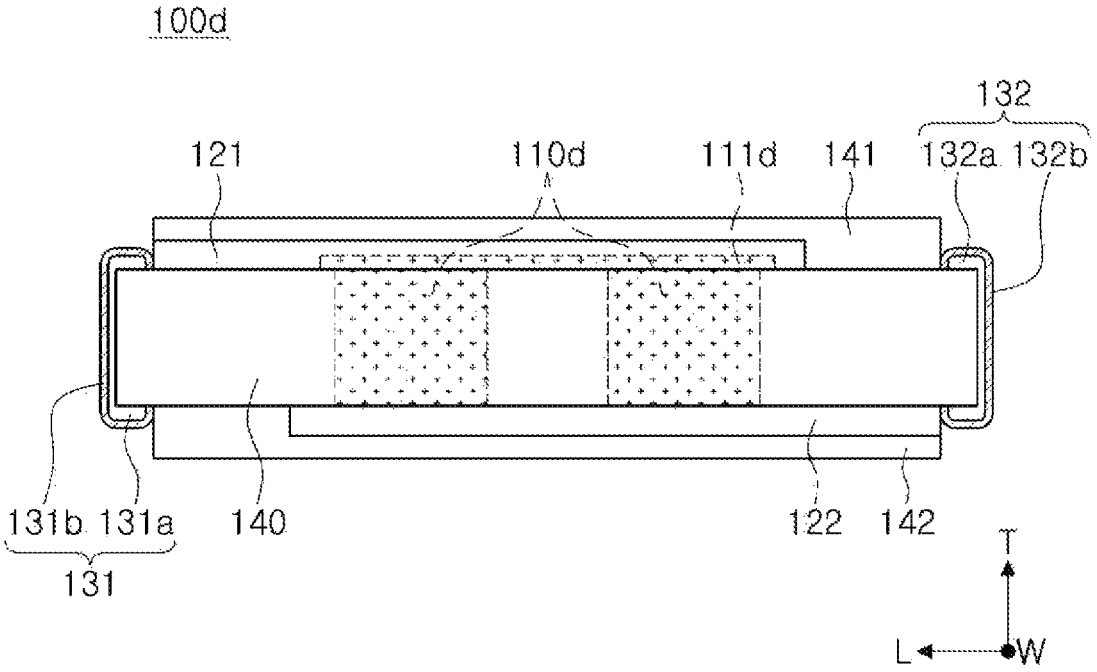

FIG. 2C is a side view illustrating a multiple core structure of a varistor according to an example embodiment.

Referring to FIG. 2C, a varistor 100*d* in the example embodiment may include a plurality of core varistor bodies 110*d* and a cover varistor body 111*d*.

The cover varistor body 111*d* may be disposed on one of an upper side and a lower side of each of the plurality of core varistor bodies 110*d*. For example, the cover varistor body 111*d* may be disposed on only one of an upper side and a lower side of each of the plurality of core varistor bodies 110*d*, but an example embodiment thereof is not limited thereto.

Figure 3A:
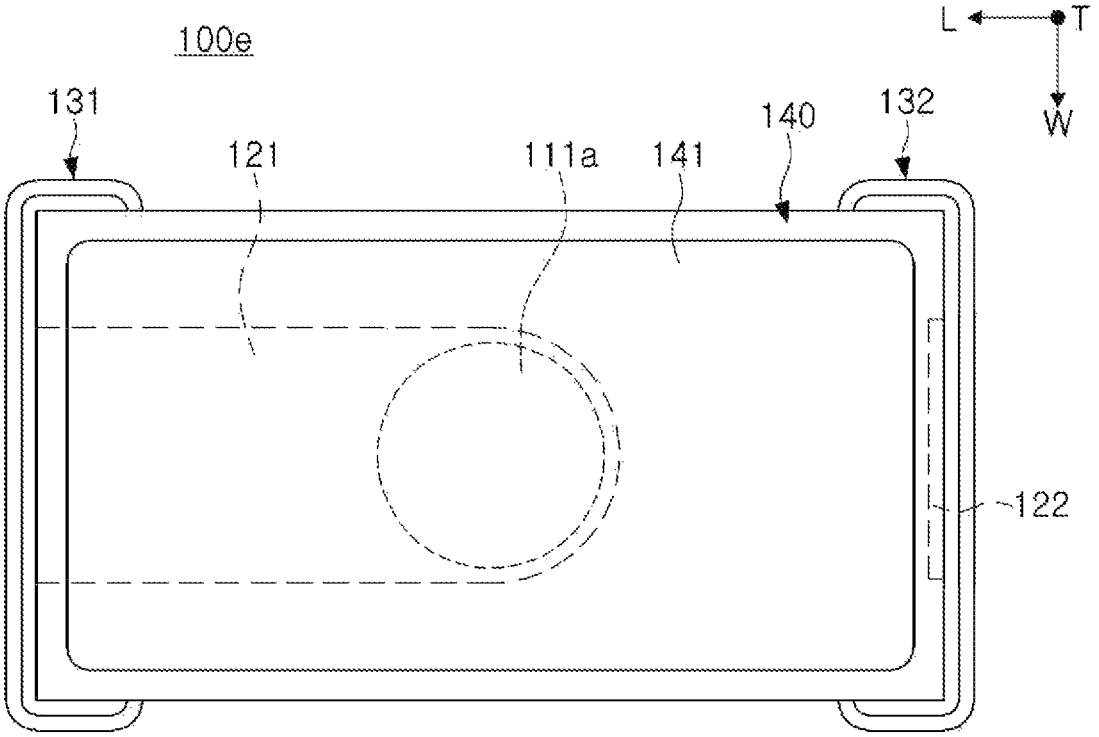
FIG. 3A is a plan view illustrating a single core structure of a varistor according to an example embodiment of the present disclosure.

FIG. 3A is a plan view illustrating a single core structure of a varistor according to an example embodiment.

Referring to FIG. 3A, a first electrode 121 of a varistor 100*e* in the example embodiment may have a width greater than a width of a cover varistor body 111*a*, and may extend to a first terminal 131 from an upper side of the cover varistor body 111*a*.

Figure 3B:
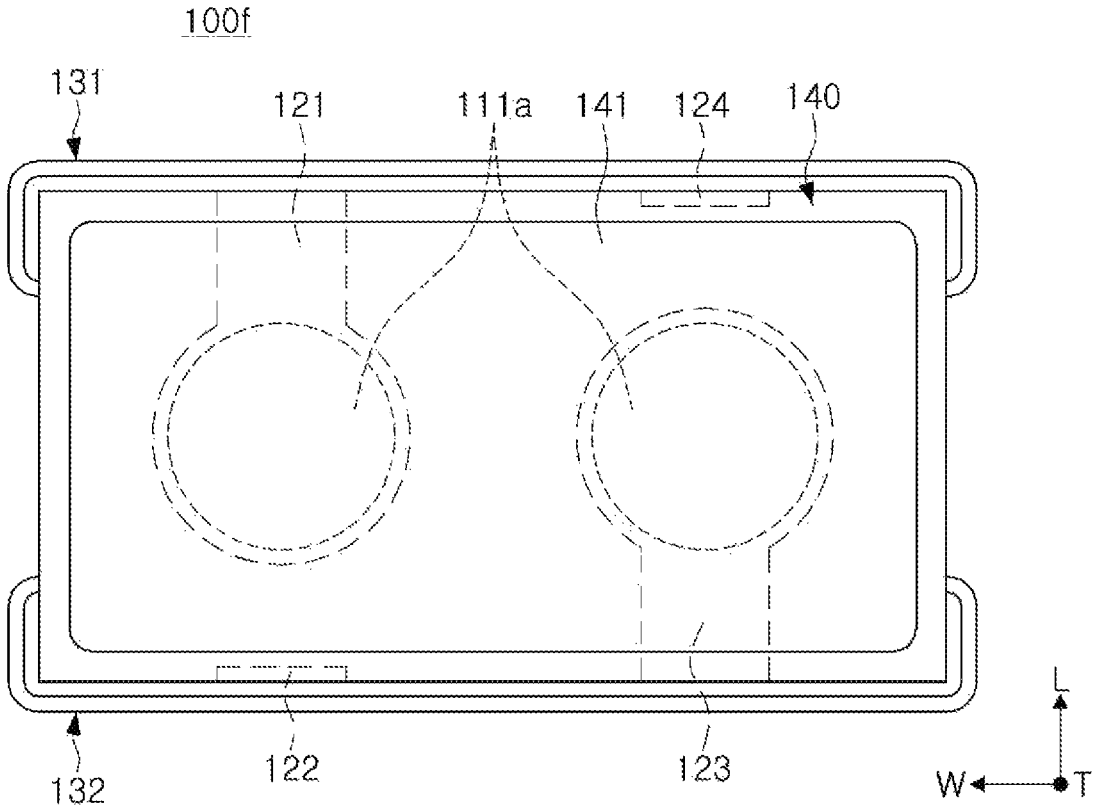
FIGS. 3B and 3C are plan views illustrating a multiple core structure of a varistor according to an example embodiment of the present disclosure.
Figure 3C:
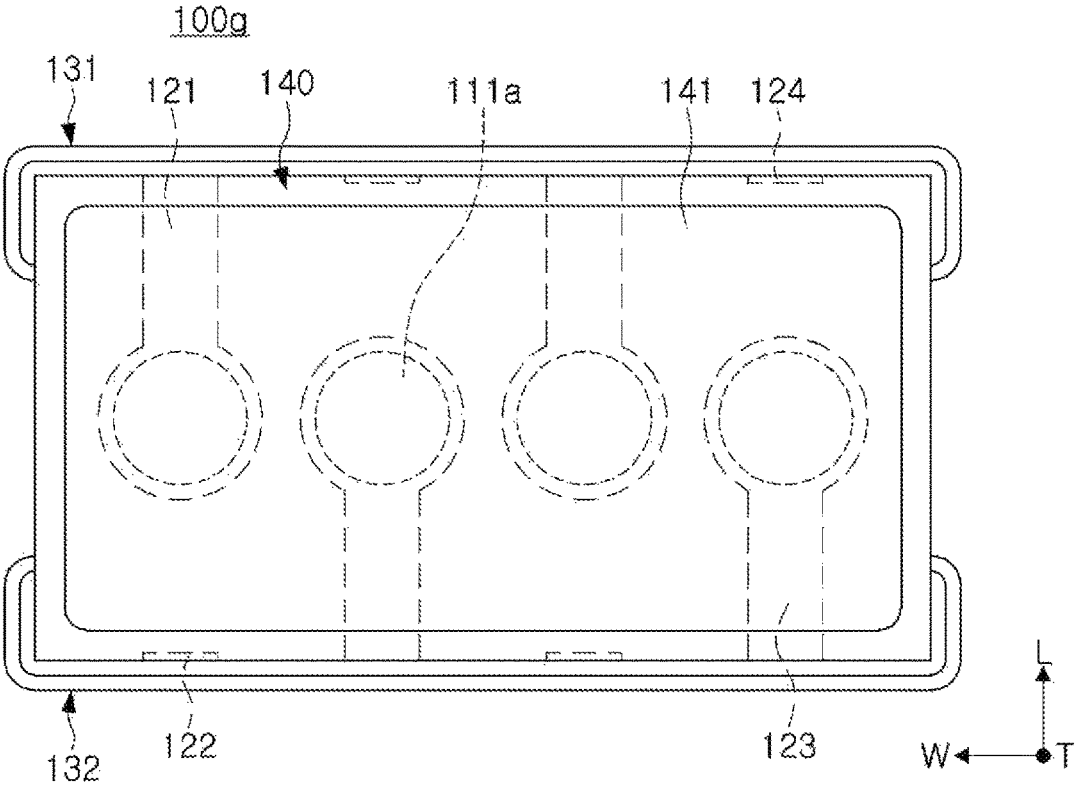

FIGS. 3B and 3C are plan views illustrating a multiple core structure of a varistor according to an example embodiment.

Referring to FIGS. 3B and 3C, varistors 100*f* and 100*g* may further include a third electrode 123 and a fourth electrode 124. A portion of a first electrode 121 covering a varistor body and a portion of a second electrode 122 covering a varistor body may overall each other, and a portion of the third electrode 123 covering a varistor body and a portion of the fourth electrode 124 covering a varistor body may overlap each other.

A plurality of cover varistor bodies 111*a* may include first and second cover varistor bodies.

The first and third electrodes 121 and 123 may be disposed on an upper side of each of the plurality of cover varistor bodies 111*a*, each of the first and third electrodes 121 and 123 may be electrically connected to one of first and second terminals 131 and 132, and the first and third electrodes 121 and 123 may be spaced apart from each other. The first and third electrodes 121 and 123 may be alternately disposed on the upper side as shown in FIG. 3C, although the present disclosure is not limited thereto.

The second and fourth electrodes 122 and 124 may be disposed on a lower surface of each of the plurality of cover varistor bodies 111*a*, each of the second and fourth electrodes 122 and 124 may be electrically connected to one of the first and second terminals 131 and 132, and the second and fourth electrodes 122 and 124 may be spaced apart from each other. The second and fourth electrodes 122 and 124 may be alternately disposed on the lower side as shown in FIG. 3C, although the present disclosure is not limited thereto.

FIGS. 3B and 3C illustrate an example in which the first and third electrodes 121 and 123 are electrically connected to the first and second terminals 131 and 132, respectively, but an example embodiment thereof is not limited thereto. In example embodiments, the first and third electrodes 121 and 123 may be connected to the first terminal 131, and the second and fourth electrodes 122 and 124 may be connected to the second terminal 132.

When the first and third electrodes 121 and 123 are electrically connected to the first and second terminals 131 and 132, respectively, and the second and fourth electrodes 122 and 124 are electrically connected to the first and second terminals 131 and 132, respectively, electrical balance in an upper side and a lower side of each of the varistors 100*f* and 100*g* may improve. Accordingly, lifespan of each of the varistors 100*f* and 100*g* may be extended.

For example, in a case in which an effect affecting a varistor body of when a voltage applied in each of the first to fourth electrodes 121, 122, 123, and 124 is a positive voltage is different from an effect affecting a varistor body of when a voltage applied in each of the first to fourth electrodes 121, 122, 123, and 124 is a negative voltage, the varistors 100*f* and 100*g* may have an extended lifespan based on electrical balance in an upper side and a lower side.

Figure 3D:
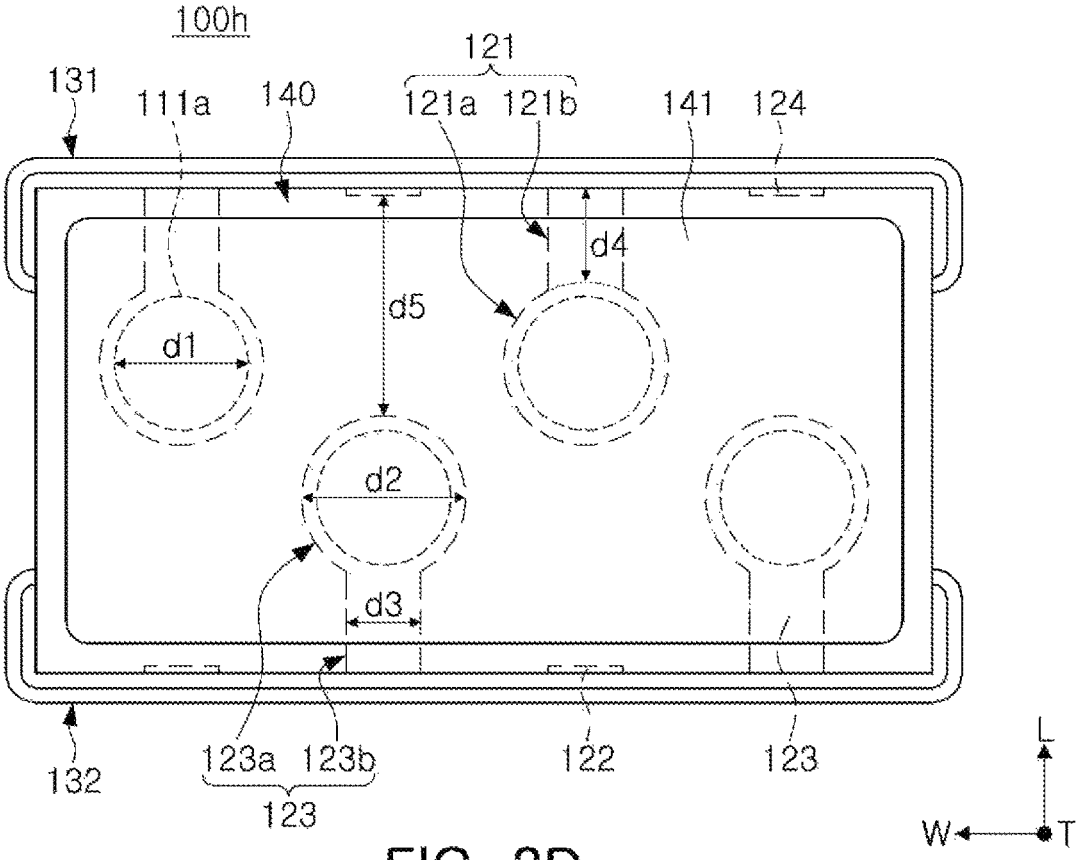
FIGS. 3D and 3E are views illustrating arrangement of cores of a multiple core structure of a varistor on an upper surface and a lower surface of the varistor according to an example embodiment of the present disclosure.
Figure 3E:
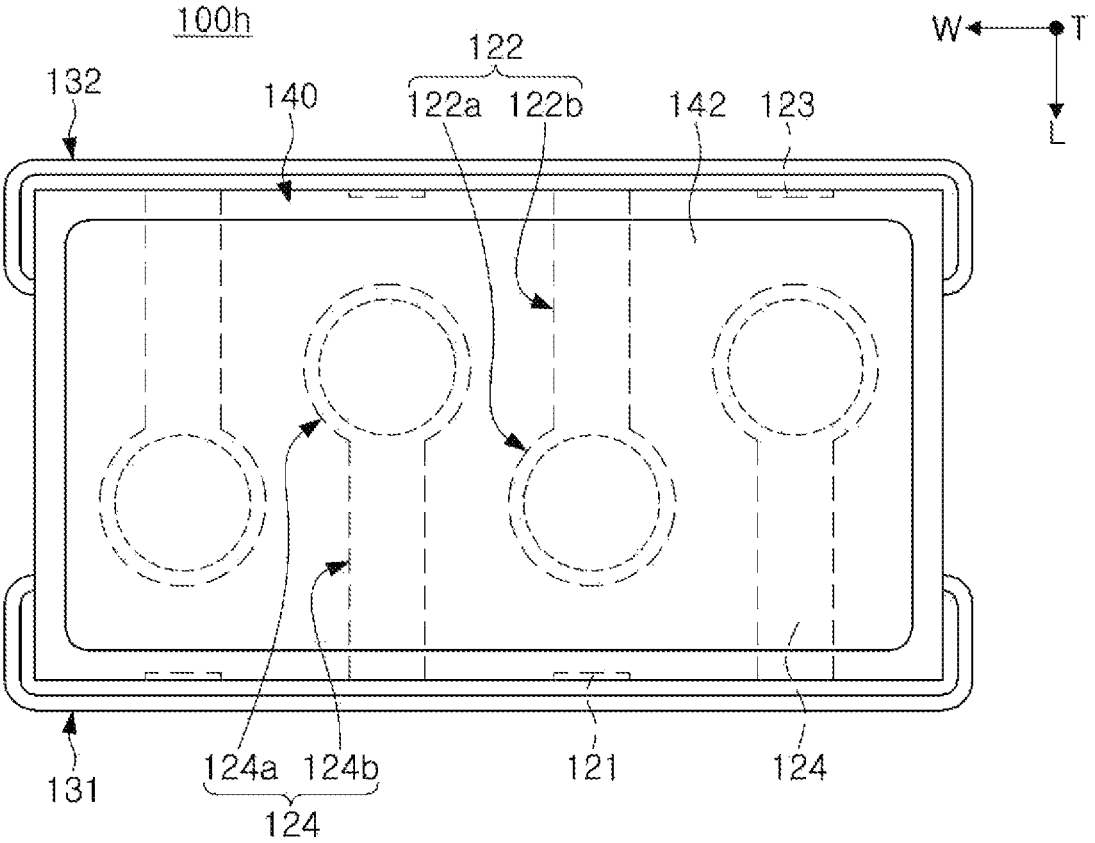
Figure 4A:
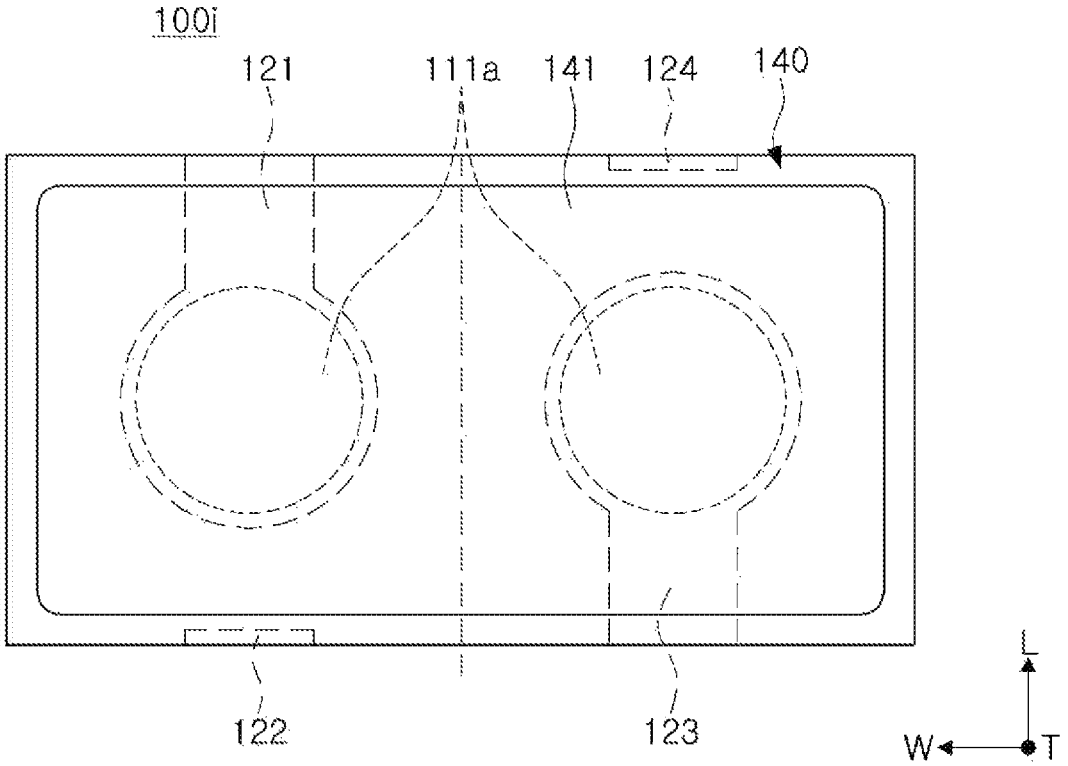
FIGS. 4A to 4D are plan views illustrating an example of a multiple varistor unit structure of a varistor according to an example embodiment of the present disclosure.
Figure 4B:
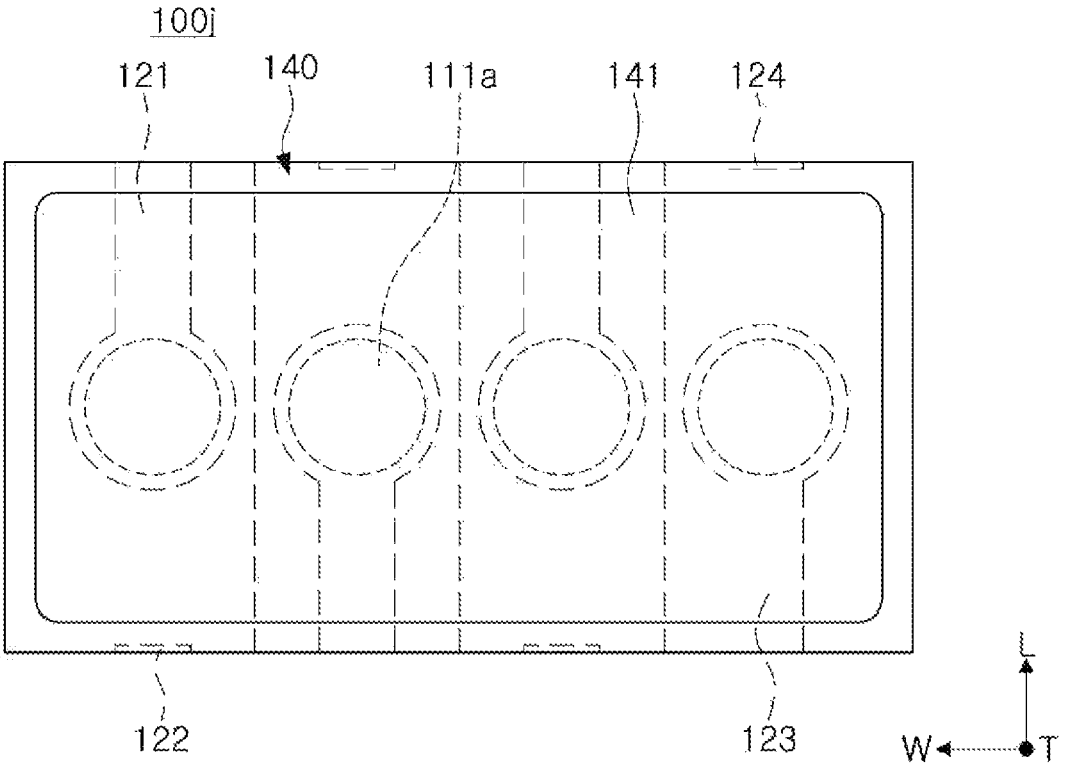
Figure 4C:
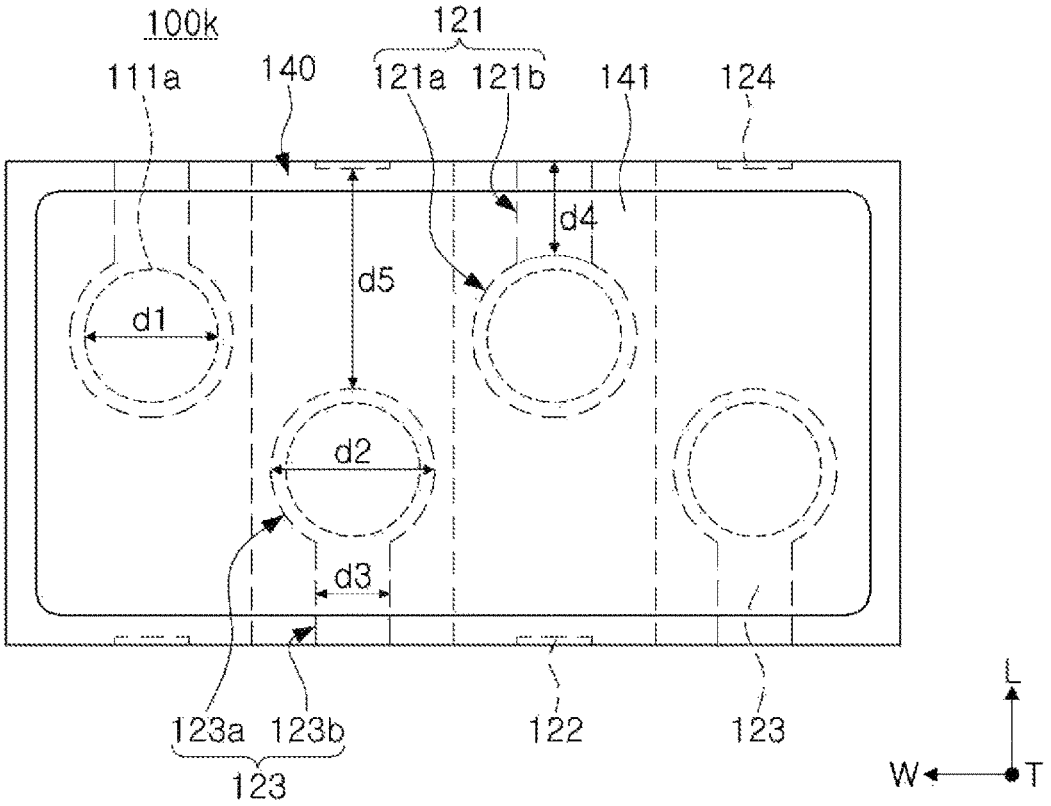
Figure 4D:
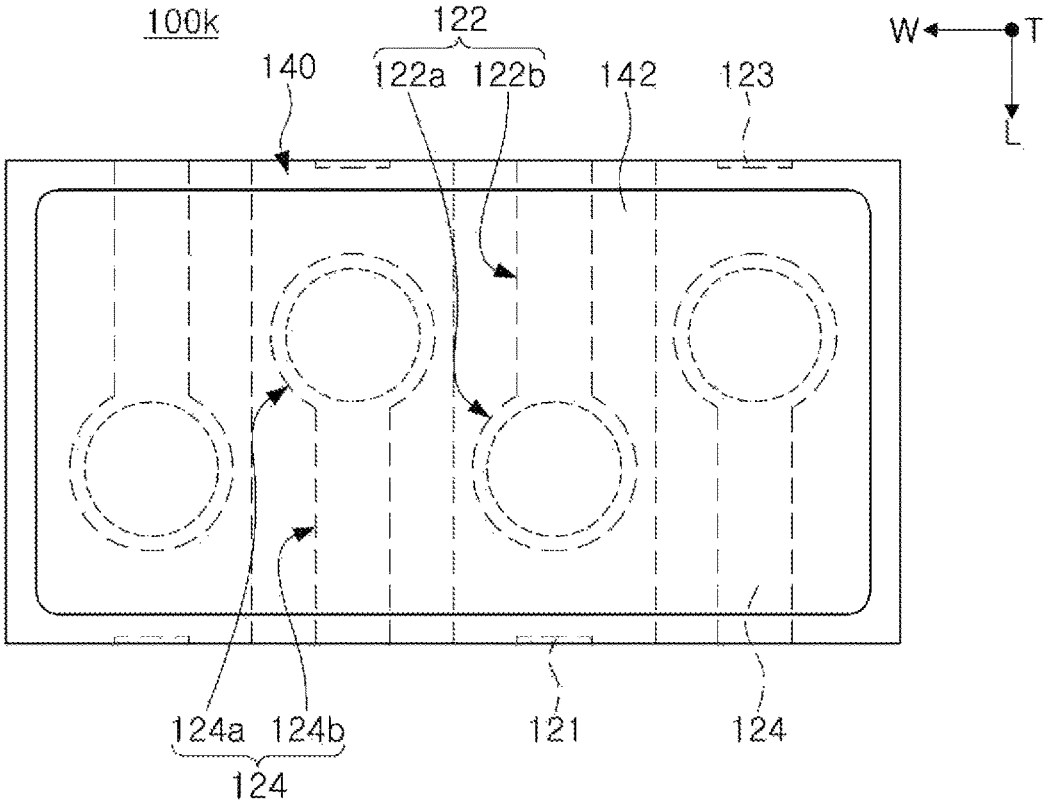

FIGS. 3D and 3E are views illustrating arrangement of cores of a multiple core structure of a varistor on an upper surface and a lower surface of the varistor according to an example embodiment.

Referring to FIGS. 3D and 3E, a portion of a plurality of cover varistor bodies 111*a* may be disposed adjacent to one side (e.g., in +L direction) from a center in a length direction, and the other portion of the plurality of cover varistor bodies 111*a* may be disposed adjacent to the other side (e.g., in −L direction) from a center in a length direction.

Accordingly, the plurality of cover varistor bodies 111*a* may have an increased width while securing a gap between the plurality of cover varistor bodies 111*a* in a substrate 140.

Thus, in the example embodiment, relatively increased strength of the substrate 140 may be effectively used in the in the varistor 100*h*, and the varistor 100*h* may have flexibly adjusted I-V properties.

A third electrode 123 may include a third cover electrode part 123*a* disposed on an upper side of each of portions of the plurality of cover varistor bodies 111*a*, and a third lead-out electrode portion 123*b* configured to electrically connect the third cover electrode portion 123*a* and a second terminal 132 to each other.

A width d2 of the third cover electrode portion 123*a* may be greater than a width d3 of the third lead-out electrode portion 123*b*.

Accordingly, in the example embodiment, the varistor 100*h* may include the plurality of core varistor bodies each having a relatively great width while securing a gap between the plurality of core varistor bodies, and insulating properties between the electrodes may improve.

Similarly to the above-described configuration, a first electrode 121 may include a first cover electrode portion 121*a* and a first lead-out electrode portion 121*b*, and second and fourth electrodes 122 and 124 may include second and fourth cover electrode portions 122*a* and 124*a* and second and fourth lead-out electrode portions 122*b* and 124*b*, respectively.

A first insulating layer 141 may cover the first and third electrodes 121 and 123 together, and the second insulating layer 142 may cover the second and fourth electrodes 122 and 124 together. Accordingly, sparks may be prevented between the first and third electrodes 121 and 123 and between the second and fourth electrodes 122.

FIGS. 4A to 4D are plan views illustrating an example of a multiple varistor unit structure of a varistor according to an example embodiment.

Referring to FIG. 4A to 4D, one of a plurality of cover varistor bodies 111*a* and one of a plurality of core varistor bodies may be included a single varistor unit. Thus, varistors 100*i*, 100*j*, and 100*k* in the example embodiment may include a plurality of varistor units.

The single varistor unit may include a single first electrode 121 or a single third electrode 123, and may include a single second electrode 122 and a single fourth electrode 124.

For example, when the varistor in the example embodiment includes an n number of varistor units, the number of a plurality of electrodes on an upper side of the substrate 140 may be n, and the number of a plurality of electrodes on a lower side of the substrate 140 may be n. In the varistor 100*i* illustrated in FIG. 4A, n may be 2, and in the varistors 100*j* and 100*k* illustrated in FIGS. 4B to 4D, n may be 4, but an example embodiment thereof is not limited thereto.

The plurality of electrodes on an upper side of the substrate 140 may be connected to different terminals, and the plurality of electrodes on a lower side of the substrate 140 may be connected to different terminals. Thus, the number of the plurality of terminals may be n. The plurality of terminals may be electrically connected to different nodes/blocks of a circuit (e.g., a chip set), or may be electrically connected to different circuits (e.g., radio frequency integrated circuits, power management integrated circuits, and the like). Accordingly, the plurality of nodes/block of a circuit or the plurality of circuits may be protected from a surge current or electrostatic discharge.

Thus, as the varistors 100*i*, 100*j*, and 100*k* in the example embodiment include the plurality of cover varistor bodies 111*a* and the plurality of core varistor bodies, reliability of each of the plurality of varistor units may improve in an assigned size of each of the plurality of varistor units.

Accordingly, each of the plurality of nodes/block of a circuit or the plurality of circuits may have a reduced assigned size to have a function of shielding a surge current or electrostatic discharge, and reliability of the function of shielding a surge current or electrostatic discharge may improve.

Figure 5A:
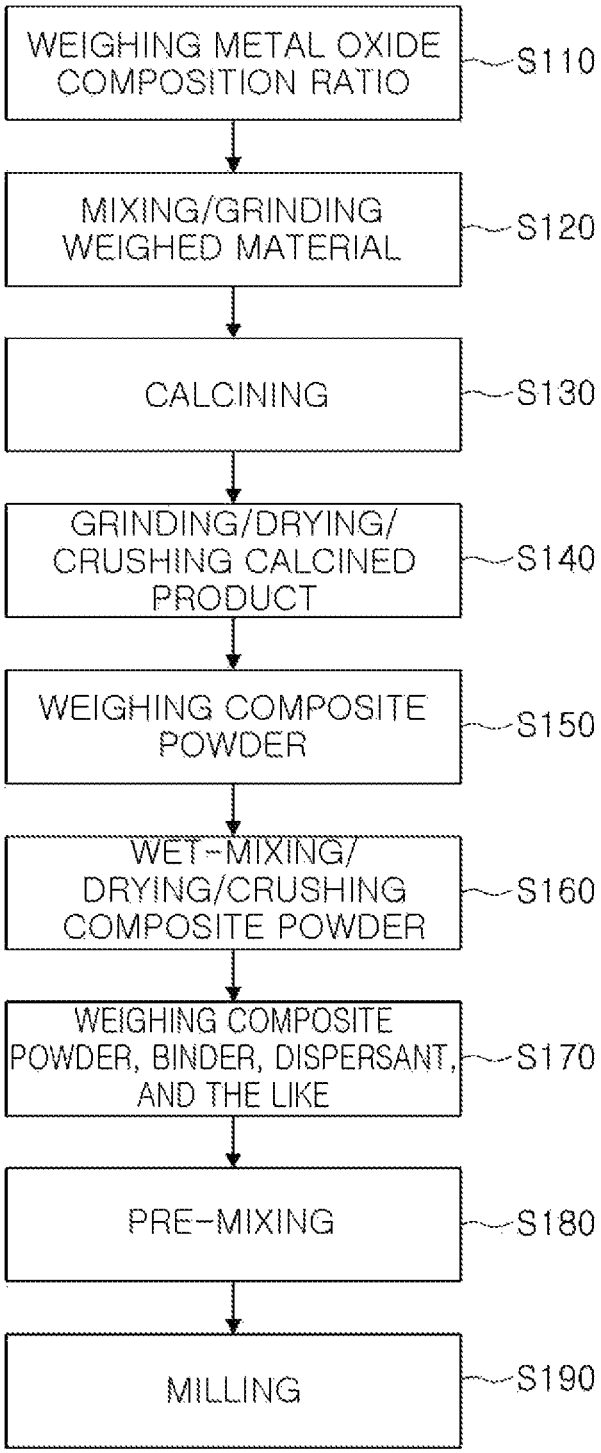
FIG. 5A is a flowchart illustrating processes of manufacturing a varistor paste used in manufacturing a varistor according to an example embodiment of the present disclosure.

FIG. 5A is a flowchart illustrating processes of manufacturing a varistor paste used in manufacturing a varistor according to an example embodiment.

Referring to FIG. 5A, a varistor paste may include weighing a metal oxide composition ratio S110, mixing/grinding a weighed material S120, calcining S130, grinding/drying/crushing a calcined product S140, weighing a composite powder S150, wet-mixing/drying/crushing a composite powder S160, weighing a composite powder, a binder, a dispersant, and the like, S170, pre-mixing S180, and milling S190.

The weighed material, the calcined product, and the composite powder may include ZnO, and when the weighed material, the calcined product, and the composite powder are a liquid phase sintered type, the weighed material, the calcined product, and the composite powder may include a transition metal oxide such as $Bi_2O_3$, Sb, Co, Mn, and the like, and an oxide additive such as Si, Ni, Zr, and the like. When the weighed material, the calcined product, and the composite powder are a solid phase sintered type, the weighed material, the calcined product, and the composite powder may include a metal oxide additive such as $Pr_6O_{11}$, Co, Mn, Cr, and the like, and an oxide additive such as Ca, Ba, Ti, and the like. A calcining temperature may be approximately 700° C., but an example of the temperature is not limited thereto.

Figure 5B:
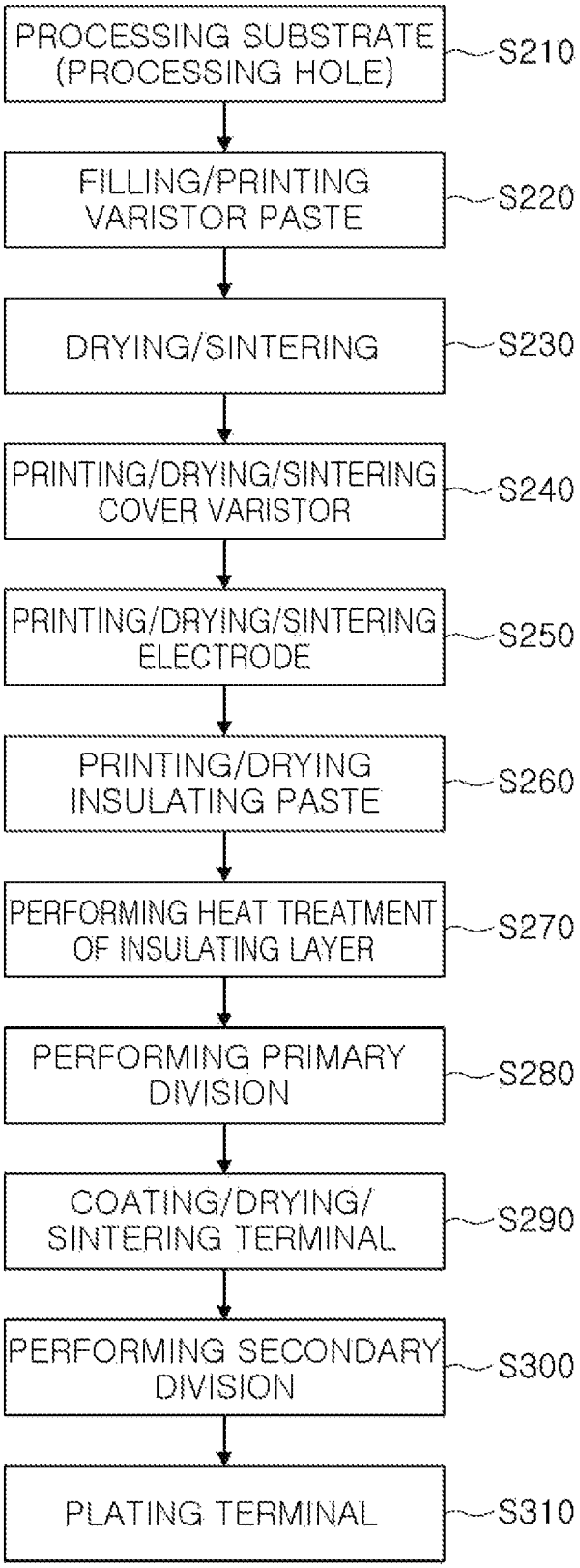
FIG. 5B is a flowchart illustrating a method of manufacturing a varistor according to an example embodiment of the present disclosure.

FIG. 5B is a flowchart illustrating a method of manufacturing a varistor according to an example embodiment.

Referring to FIG. 5B, a method of manufacturing a varistor in the example embodiment may include at least portions of processing a substrate S210, filling/printing a varistor paste S220, drying/sintering S230, printing/drying/sintering a cover varistor S240, printing/drying/sintering an electrode S250, printing/drying an insulating paste S260, performing a heat treatment on an insulating layer S270, performing a primary division S280, coating/drying/sintering a terminal S290, performing a secondary division S300, and plating a terminal S310.

The processing a substrate S210 include forming a through-hole in a substrate. The through-hole may be processed using a laser, but an example embodiment thereof is not limited thereto.

The filling/printing a varistor paste S220 may include printing a first varistor paste on the through-hole. The first varistor paste may include the material prepared by the method described with reference to FIG. 5A.

The drying/sintering S230 may include drying a substrate in which at least a portion of the through-hole is filled with the first varistor paste. A temperature of the drying may be approximately 130° C., but an example of the temperature is not limited thereto.

The printing/drying/sintering a cover varistor S240 may include printing a second varistor paste on an upper side or a lower side of the through-hole of the dried substrate, and may include sintering the substrate on which the second varistor paste is printed. The second varistor paste may include the material prepared by the method described with reference to FIG. 5A. In one embodiment, the first and second varistor paste may be made of the same material containing, for example, the material prepared by the method described with reference to FIG. 5A, although the present disclosure is not limited thereto. A temperature of the sintering may be 900° C. to 1150° C., but an example of the temperature is not limited thereto.

The printing/drying/sintering an electrode S250 may include forming first and second electrodes on an upper side and a lower side of the sintered substrate.

For example, the forming an electrode S250 may include printing an electrode paste on an upper side and a lower side of the sintered substrate and sintering the printed electrode paste at a temperature lower than a temperature of the sintering and higher than a temperature of the drying, thereby forming the first and second electrodes. A temperature of the sintering an electrode may be approximately 600° C., and a time for sintering an electrode may be approximately 45 minutes, but example embodiments thereof is not limited thereto.

The coating/drying/sintering a terminal S290 may include forming first and second terminals on one side and the other side of the sintered substrate. The first and second terminals may be formed by a dipping process and a sputtering process, and may be plated through a plating process, but an example embodiment thereof is not limited thereto.

According to the aforementioned example embodiments, the varistor may have improved strength and/or a structure facilitating miniaturization.

Also, operational reliability of the varistor may improve in assigned strength and size, and properties of the varistor (e.g., I-V properties, capacitance properties, breakdown voltage properties, maximum current properties, and the like) may be flexibly designed and stably implemented.

Further, the varistor may provide a multiple varistor unit, and may improve reliability of each of the multiple varistor units in an assigned size of each of the multiple varistor units. Accordingly, each of a plurality of nodes/block of a circuit or a plurality of circuits may have a reduced assigned size to have a function of shielding a surge current or electrostatic discharge, and reliability of the function of shielding a surge current or electrostatic discharge may improve.

While the example embodiments have been shown and described above, it will be apparent to those skilled in the art that modifications and variations could be made without departing from the scope of the present invention as defined by the appended claims.

What is claimed is:

1. A varistor, comprising:

a substrate;

first and second electrodes disposed on an upper side and a lower side of the substrate, respectively;

a first core varistor body surrounded by the substrate and disposed between the first and second electrodes;

first and second terminals having at least portions disposed on one side and the other side of the substrate, respectively, and connected to the first and second electrodes, respectively;

a first cover varistor body covering the first core varistor body and disposed in a level higher than an upper surface of the substrate or disposed in a level lower than a lower surface of the substrate;

a second core varistor body surrounded by the substrate; and a second cover varistor body covering the second core varistor body and disposed in a level higher than the upper surface of the substrate or disposed in a level lower than the lower surface of the substrate, wherein the second cover varistor body covers the first cover varistor body, and the first cover varistor body and the second cover varistor body are disposed on opposite sides of the substrate.

2. The varistor of claim 1, wherein the first cover varistor body has an upper surface or a lower surface having an area greater than that of an upper surface or a lower surface of the first core varistor body.

3. The varistor of claim 2, wherein the first cover varistor body is disposed on an upper side and a lower side of the first core varistor body and has an I-shaped form with the first core varistor body.

4. The varistor of claim 3, wherein a width of each of the first and second electrodes is greater than a width of the first cover varistor body and less than a width of the substrate.

5. The varistor of claim 1, wherein one of the first and second electrodes is configured to cover at least a portion of the first cover varistor body and at least a portion of the second cover varistor body together.

6. The varistor of claim 1, wherein the first varistor body includes ZnO, and the substrate is configured as an alumina substrate.

7. A varistor comprising:

a substrate;

first and second electrodes disposed on an upper side and a lower side of the substrate, respectively;

a first core varistor body surrounded by the substrate and disposed between the first and second electrodes;

first and second terminals having at least portions disposed on one side and the other side of the substrate, respectively, and connected to the first and second electrodes, respectively;

a first cover varistor body covering the first core varistor body and disposed in a level higher than an upper surface of the substrate or disposed in a level lower than a lower surface of the substrate;

a second core varistor body surrounded by the substrate;

a second cover varistor body covering the second core varistor body and disposed in a level higher than the upper surface of the substrate or disposed in a level lower than the lower surface of the substrate;

a third electrode having one portion disposed on an upper side of the second core varistor body or the second cover varistor body; and a fourth electrode having one portion disposed on a lower side of the second core varistor body or the second cover varistor body, wherein one portion of the first electrode is disposed on an upper side of the first core varistor body or the first cover varistor body and is spaced apart from the third electrode, one portion of the second electrode is disposed on a lower side of the first core varistor body or the first cover varistor body and is spaced apart from the fourth electrode, the third and fourth electrodes include third and fourth cover electrode portions disposed on an upper side or a lower side of the second core varistor body or the second cover varistor body, and third and fourth lead-out electrode portions configured to connect the third and fourth cover electrode portions to the first and second terminals, respectively, and a width of each of the third and fourth cover electrode portions is greater than a width of each of the third and fourth lead-out electrode portions.

8. The varistor of claim 7, wherein the third and fourth electrodes extend in a length direction, and one of the first core varistor body and the second core varistor body is disposed adjacent to one side from a center of the substrate in the length direction, and the other one of the first core varistor body and the second core varistor body is disposed adjacent to the other side from the center of the substrate in the length direction.

9. The varistor of claim 7, further comprising:

a first insulating layer covering the first and third electrodes; and a second insulating layer covering the second and fourth electrodes, wherein the third electrode is connected to the second terminal, and the fourth electrode is connected to the first terminal.

10. A varistor, comprising:

a substrate;

a first core varistor body penetrating through the substrate and exposed from upper and lower surfaces of the substrate;

first and second terminals disposed on opposing sides of the substrate, respectively, and extending onto the upper and lower surfaces of the substrate;

a first electrode extending from an extending portion of the first terminal on the upper surface and covering a first end of the first core varistor exposed from the upper surface;

a second electrode extending from an extending portion of the second terminal on the lower surface and covering a second end of the first core varistor exposed from the lower surface;

a second core varistor body penetrating through the substrate and exposed from the upper and lower surfaces of the substrate;

a third electrode extending from the extending portion of the first terminal on the upper surface and covering a third end of the second core varistor exposed from the upper surface; and a fourth electrode extending from the extending portion of the second terminal on the lower surface and covering a fourth end of the second core varistor exposed from the lower surface, wherein the first and third electrodes are spaced apart from each other, and the second and fourth electrodes are spaced apart from each other.

11. The varistor of claim 10, further comprising a cover varistor body covering one of the first and second ends of the core varistor body and having a width greater than that of the one of the first and second ends of the core varistor body, wherein the cover varistor body is disposed between the one of the first and second ends of the core varistor body and one of the first and second external electrodes.

12. The varistor of claim 10, wherein the substrate has a strength greater than that of the first core varistor body.

13. A varistor, comprising:

a substrate;

a first core varistor body penetrating through the substrate and exposed from upper and lower surfaces of the substrate;

first and second terminals disposed on opposing sides of the substrate, respectively, and extending onto the upper and lower surfaces of the substrate;

a first electrode extending from an extending portion of the first terminal on the upper surface and covering a first end of the first core varistor exposed from the upper surface;

a second electrode extending from an extending portion of the second terminal on the lower surface and covering a second end of the first core varistor exposed from the lower surface; and a second core varistor body penetrating through the substrate and exposed from the upper and lower surfaces of the substrate, wherein the first electrode covers a third end of the second core varistor exposed from the upper surface, and the second electrode covers a fourth end of the second core varistor exposed from the lower surface.

* * * * *